US005363614A

United States Patent [19]

Faulkner

[11] Patent Number: 5,363,614

[45] Date of Patent: Nov. 15, 1994

[54] TERRACE FLOOR AND METHOD OF CONSTRUCTING SAME

[75] Inventor: David L. Faulkner, Scio, N.Y.

[73] Assignee: Syrstone, Inc., North Syracuse, N.Y.

[21] Appl. No.: 30,834

[22] Filed: Mar. 12, 1993

[51] Int. Cl.[5] ..... E04F 15/08

[52] U.S. Cl. ..... 52/263; 52/262; 52/480

[58] Field of Search ..... 52/262, 263, 480

[56] References Cited

U.S. PATENT DOCUMENTS

| | | | |
|---|---|---|---|
| Re. 20,872 | 5/1933 | Focht . | |
| 1,169,212 | 1/1916 | Weber . | |
| 3,065,506 | 8/1956 | Tremer . | |
| 3,307,302 | 7/1963 | Gutierrez . | |
| 3,504,472 | 9/1967 | Clement . | |
| 4,883,503 | 11/1989 | Fish . | |
| 5,052,157 | 10/1991 | Ducroux et al. | 52/263 |

OTHER PUBLICATIONS

PAVE-EL Envirospec Incorporated, Prices and Product Specifications.

Terr-Adjust Pedestal Insert.

Hanover Paver Support Pedestals-Support Product Information.

*Primary Examiner*—Carl D. Friedman

*Assistant Examiner*—Christopher Todd Kent

*Attorney, Agent, or Firm*—Harris Beach & Wilcox

[57] ABSTRACT

A horizontally level terrace floor having a plurality of solid blocklike support pedestals composed of a heat shearable material, that are directly affixed in spaced apart relationship onto a substructure. The support pedestals have been sheared to produce upper surfaces that are all horizontally level with respect each other. Atop the support pedestals are a plurality of joint dividers, and, a plurality of paving blocks are laid directly on the support pedestals, abutting the joint dividers.

18 Claims, 7 Drawing Sheets

TERRACE FLOOR AND METHOD OF CONSTRUCTING SAME

BACKGROUND OF THE INVENTION

This invention relates to a terrace floor and the method for constructing the same. More particularly this invention relates to a level terrace floor that can be rapidly and inexpensively laid over a substructure which is sloping and/or irregular.

The creation of a terrace floor over a deck or rooftop area presents far greater technical problems than that of laying a floor indoors or on the ground. Terrace floors are partially or entirely exposed to weather, including rain. Therefore the underlying surface is generally sloped in one or more directions in order to provide drainage and avoid the myriad of problems associated with standing water. When a terrace or rooftop area is put into use for additional purposes involving pedestrian traffic, such as lounging, eating or recreation, the drainage needs do not disappear. At the same time, the floor surface must be level. It is therefore imperative that a terrace floor constructed in such an area accommodate both human and structural needs.

A terrace floor therefore needs to be essentially horizontally level to accommodate normal human usage, and yet at the same time allow for water drainage therethrough to a sloped surface, directing the water to one or more drainholes for eventual removal through gutters, pipes or the like.

In order to provide drainage through the terrace floor to the underlying sloped surface, terrace floors generally consists of paving blocks which are close enough to one another so as not to cause a danger to those walking on the floor, especially when wearing high heels, while at the same time sufficiently apart to allow for water drainage between the blocks. There must be a space beneath these blocks so that water may flow across the sloped substructure to one or more drains, without carrying along associated debris. There must be sufficient access to the drains to prevent clogging. And, finally, as already noted, the terrace floor must be essentially horizontally level.

Thus, the problem in creating a terrace floor involves laying a horizontal surface upon a sloping substructure while providing sufficient drainage to rapidly carry away surface water. It follows that the supports for the blocks comprising the uppermost surface cannot all be of the same height. Those located on the upward part of the substructure slope will, of necessity, be shorter than those on the bottom portion of the substructure slope.

Various structures have been used in constructing terrace floor systems and various methods used in conjunction with these different structures. However the prior art structures have all tended to be complex and thus more expensive. Often they cannot easily accommodate to construction irregularities of the substructure or of the paving blocks. The pedestals were frequently affixed to the substructure via special receptacles, screws, bolts or the like. This has the disadvantage of requiring substantial extra parts or preparation and also being subject to degradation effects, such as misalignment, over time. In cases where the pedestals are not affixed to the substructure, however, they were liable to shift during construction or in use, or to cause sliding in the underlying protective board. In addition, the manipulation required for the construction can result in damage to the thin sheet of waterproofing material which is normally laid directly on top of the bottommost layer, which, in turn, is generally a concrete slab. The process of installation of these prior art structures has been correspondingly slow, complicated, and expensive.

Structures of the previous art frequently used parts composed of metal and various other materials which are subject to corrosion and other adverse effects due to weathering. Very often relatively thin pedestals were used. These could become unstable under heavy weight loads.

The weight of the structure itself is also a concern in terrace floors as the substructure is a roof or balcony or the like rather than the ground. Some prior art structures used cement or metal pedestals which added substantially to the weight of the floor. This could result in the substructure needing extra bolstering and also result in additional stress leading to wear and tear.

In addition, the previous art terrace floors contained components could lend resilience, which meant that they did not comfortably accommodate small irregularities or shifts in the substructure or paving blocks and were extremely uncomfortable to walk upon.

U.S. Pat. No. 3,307,302 to Gutierrez shows the construction of a terrace floor with drainage means where paving blocks are laid across H-shaped pieces. Levelling is accomplished by filling intermediate supports with mortar to different depths. The H-shaped pieces can be warped by weight stresses.

U.S. Pat. No. 3,065,506 to Tremer involves the use of adjustable vertical pedestals for supporting and leveling paving blocks on a sloping roof. The pedestals are adjusted by means of threaded members which must be individually set to exacting heights during construction. A pedestal can be easily placed out of alignment by vibration, dropped objects, people walking and the like. These pedestals could warp or move out of alignment after some time, causing the paving blocks which are supported thereby to rock and show other signs of instability.

Another known system uses different numbers of stacked levelling plates to achieve the necessary differing distances between the substructure and the surface slabs. Still another system uses telescoping tiltable pedestals which, once properly set to level, are filled with a solidifying mixtures to achieve permanent positioning.

In each of these systems every pedestal or pedestal must be individually and painstakingly set, during the construction process, to an exact height and angle with respect to the substructure.

SUMMARY OF THE INVENTION

It is therefore a primary object of the present invention to provide a horizontally level, drainage providing terrace floor that is simply and rapidly installable.

It is another object of this invention to provide a horizontally level, drainage providing terrace floor where a group of support pedestals are rapidly horizontally leveled in a single operation.

It is yet another object of this invention to provide a horizontally level, drainage providing terrace floor where a plurality of supple support pedestals are horizontally leveled in one simple operation.

It is still another object of this invention to provide a method for simply and rapidly installing a horizontally level, drainage providing terrace floor.

It is still another object of this invention to provide a method for simply and rapidly installing a horizontally level, drainage providing terrace floor, in which the tops of short rows or cross-rows of support pedestals are sheared in a single operation so that all support pedestal tops are at the same horizontal level.

It is still another object of this invention to provide a method for simply and rapidly installing a horizontally level, drainage providing terrace floor, in which the support pedestals are broad based, stable, lightweight, and capable of tolerating heavy loads.

These and other objects of the present invention are attained by a horizontally level terrace floor having a plurality of solid blocklike support pedestals composed of a heat shearable material, that are directly affixed in spaced apart relationship onto a base or substructure. The support pedestals have been sheared to produce upper surfaces that are all horizontally level with respect to each other. Atop the support pedestals are a plurality of joint dividers, and, a plurality of paving blocks are laid directly on the support pedestals, abutting against the joint dividers.

BRIEF DESCRIPTION OF THE DRAWINGS

For a better understanding of these and other objects of the present invention, reference is made to the detailed description of the invention which is to be read in conjunction with the following drawings, wherein.

DETAILED DESCRIPTION OF THE INVENTION

Figure 1:
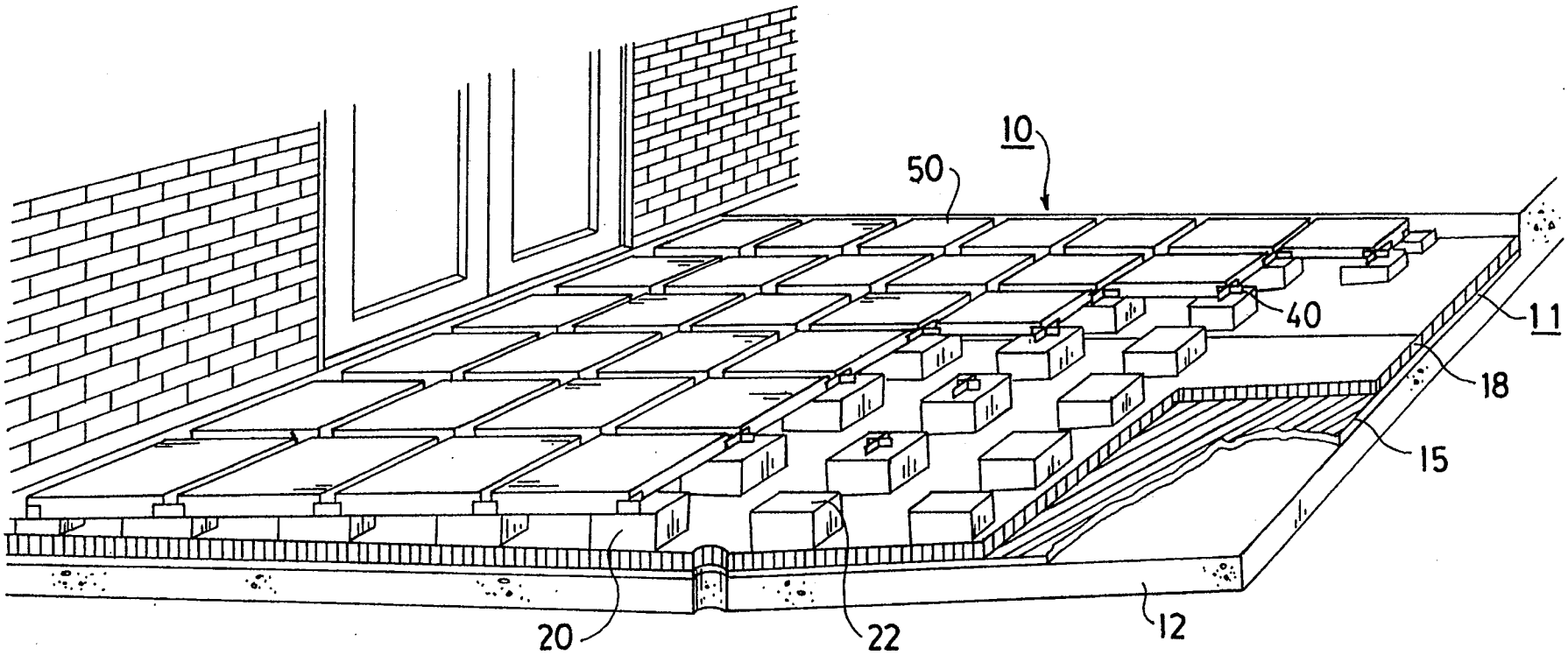
FIG. 1 is a perspective view of the terrace floor of this invention, broken away in part to more thoroughly illustrate the construction thereof.
Figure 2:
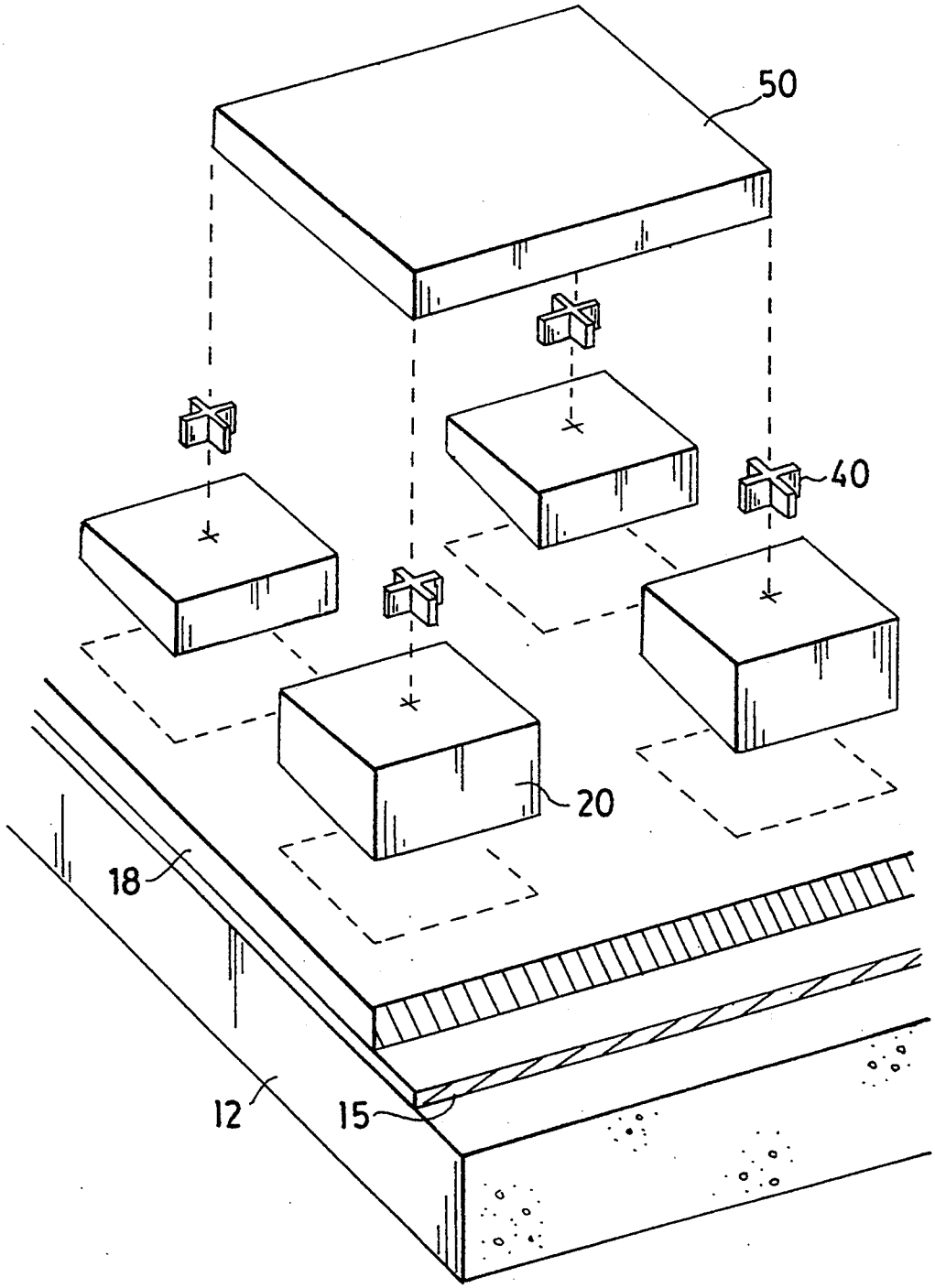
FIG. 2 is an exploded perspective view of a portion of the terrace floor of FIG. 1.

Referring, now, to FIGS. 1 and 2, there is shogun a terrace floor 10 constructed according to the instant invention. The base or substructure 11 of the floor comprises a concrete floor slab 12, over which is laid a waterproofing membrane 15 to protect the concrete from the weathering effect of rain and the like to which the floor is exposed. Over that is laid a layer of protective board 18 which prevents scratches and tears to the waterproofing membrane and also provides insulation. Alternatively, a thin but tough board may be used for protection and additional insulation material may be installed as a separate layer either above or below the board. As another alternative a plurality of insulation layers may be placed beneath the waterproof sheeting. The varied order in which these materials are placed is well known in the art.

In the preferred embodiment solid blocklike, heat shearable, lightweight, polystyrene support pedestals 20 are placed in a spaced apart rectangular grid pattern on top of the substructure 11 and affixed thereto by gluing using polystyrene adhesives of the type that are well known in the art. This method of affixing the pedestals to the substructure avoids excess manipulation which could damage the underlying layer of waterproofing membrane. The shape of the support pedestal is such that a relatively large, flat surface contacts the underlying surface resulting in a very stable structure. Larger cross-sectional pedestals can be used if unusually heavy weights are to be borne by the floor. Polystyrene is an especially good material for this purpose as it is lightweight and easily sheared using a hot wire and as it also lends a small amount of resiliency to the floor. It is also extremely strong for its weight; polystyrene is available in forms resistent to being depressed by forces of from 40 to 115 psi. The strength of polystyrene chosen depends upon the forces to which the floor will be exposed. The top surfaces of the polystyrene support pedestals 20 are all sheared off as will be described later so that the resulting top surfaces 22 are all at the same horizontal level.

In the center of each top surface 22 is placed a joint divider 40. In the preferred embodiment, each joint divider 40 is cruciform in shape and is aligned so that each crosspiece thereof is parallel to an edge of the polystyrene support pedestal 20. Paving blocks 50 are laid so that one rests across four the polystyrene support pedestals 20 with each corner of a paving block 50 abutting a corresponding elbow of a joint divider 40. In the preferred embodiment, each joint divider is comprised of material which is resilient and ultra-violet resistent. Solid neoprene and some forms of rubber are ideal for this purpose. This allows the joint dividers to have some "give" allowing small adjustments to the alignment of the paving blocks 50. Edges and/or corners of the terrace floor can be laid, if necessary, by using polystyrene support pedestals 20 of smaller cross section, as appropriate, and either omitting joint dividers 40 or using "T" or other appropriately shaped joint dividers rather than cruciform shaped ones.

It is possible to use other geometric shapes of paving blocks such as pentagons, hexagons or even asymmetrical shapes, as long as the requirements of fairly close fitting are met and the joint dividers are fabricated to accommodate the shape used. If desired, a filter fabric may be interposed between the top of the polystyrene support pedestals 20 and the joint dividers 40 in order to help prevent debris from reaching the drains, as is well known in the art.

Figure 6:
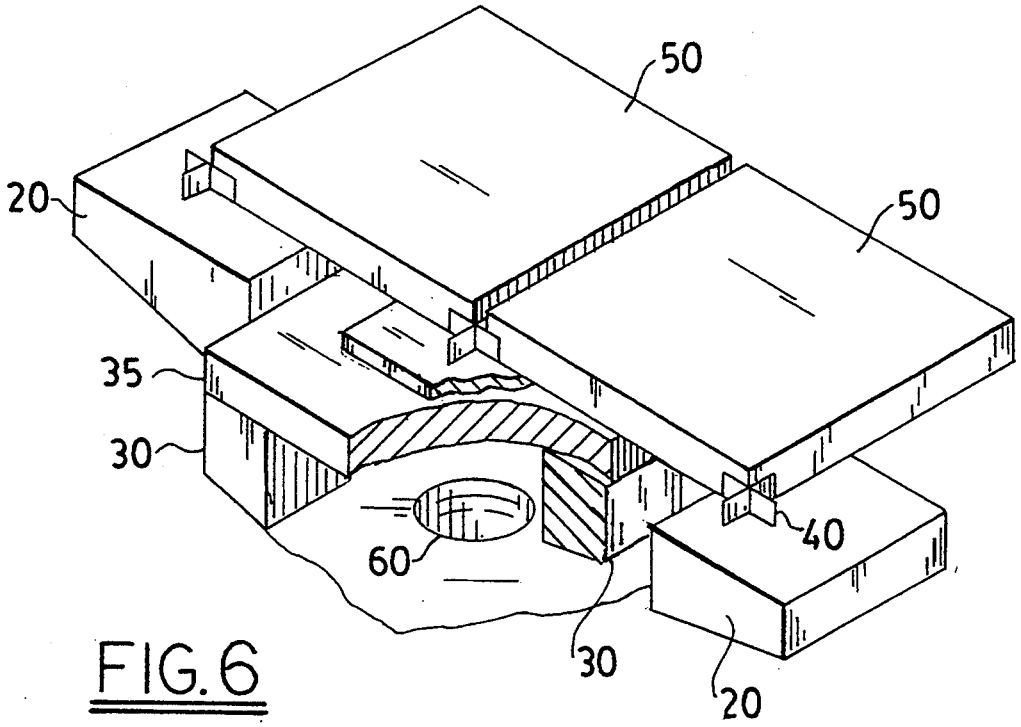
FIG. 6 is a perspective view of a drain hole covering in a portion the terrace floor of this invention, broken away in part to more thoroughly illustrate the construction thereof.
Figure 7:
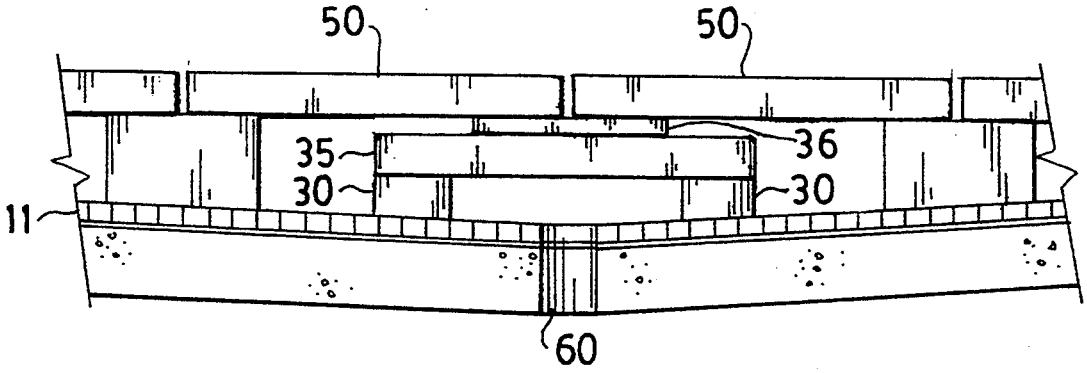
FIG. 7 is a cross sectional view of the terrace floor of this invention in the region of a drain hole.
Figure 8:
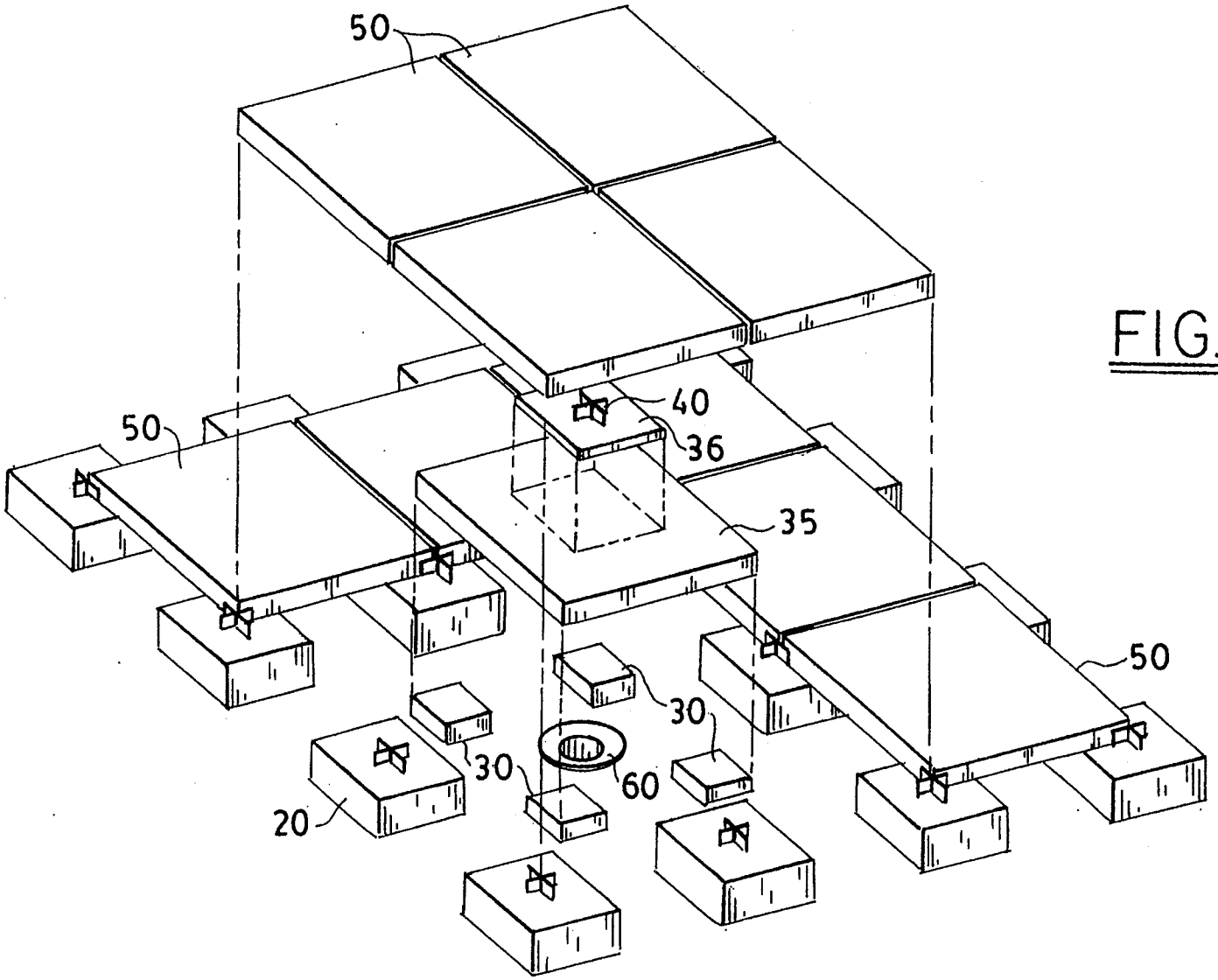
FIG. 8 is an exploded perspective view of the terrace floor of this invention in the region of a drainhole.

Due to the fact that terrace floors are by definition laid on an outdoor portion of a building, such as a rooftop or balcony the underlying surface generally slopes to drain surface water into drainholes. This causes a special problem when the grid pattern of placement of polystyrene support pedestals 20 would result in a pedestal being located directly over a drainhole, thus blocking it. In this case, the drain covering construction shown in FIGS. 6, 7 and 8 is preferred.

Rather than place a standard sized polystyrene support pedestal 20 over the drainhole 60, four smaller polystyrene support posts 30—30 are placed in a symmetrical spaced-apart relationship surrounding the drainhole 60 and leveled so that when a single paving block 35 is placed resting across the four smaller polystyrene support posts 30—30, there is sufficient room for placing a thin section of polystyrene pedestal 36 on top of the paving block 35 so that the top of the thin section of polystyrene pedestal is horizontally level with the top of the sheared standard sized polystyrene support pedestals 20. This clears the inlet to the drainhole 60 as the support surrounds it rather than being directly atop it. By using a paving block 35 and a thin section of support pedestal 36 in this construction no additional materials need to be fabricated, and, furthermore, paving blocks which cannot be used on the surface due to chipping, discoloring or other minor faults can be used as well as remnants of sheared support pedestals.

It should be noted that the term "standard sized polystyrene support pedestal" refers to the cross sectional dimensions of the polystyrene support pedestals generally used in forming the terrace floor. Once these pedestals have all been sheared to achieve mutually horizontally level top surfaces the pedestals may have differing heights from one another, and therefore are not all the same size.

Figure 3:
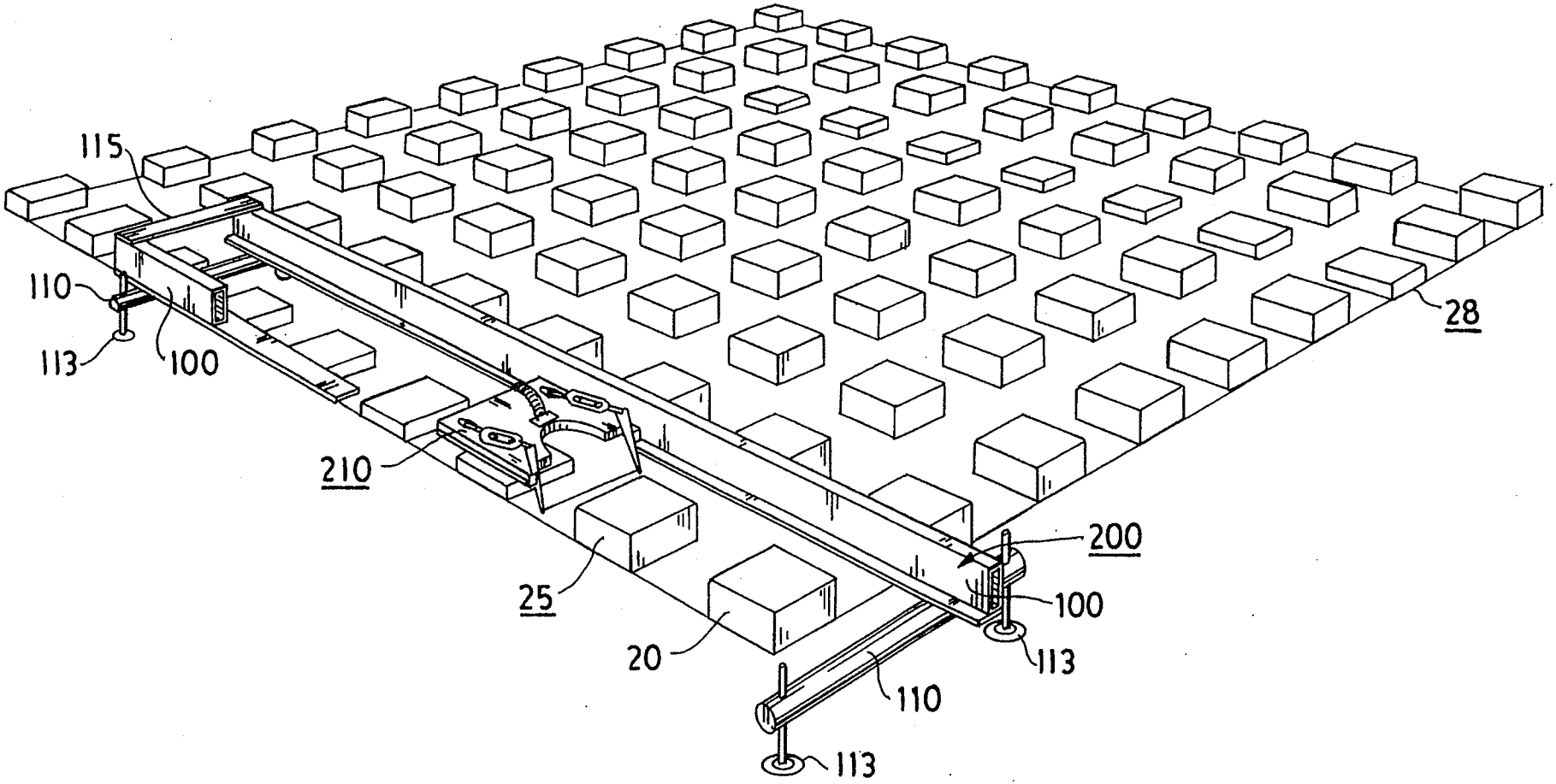
FIG. 3 is a perspective view showing the horizontal leveling of a single row of support pedestals, with one track of the levelling machine partially cut away.
Figure 4:
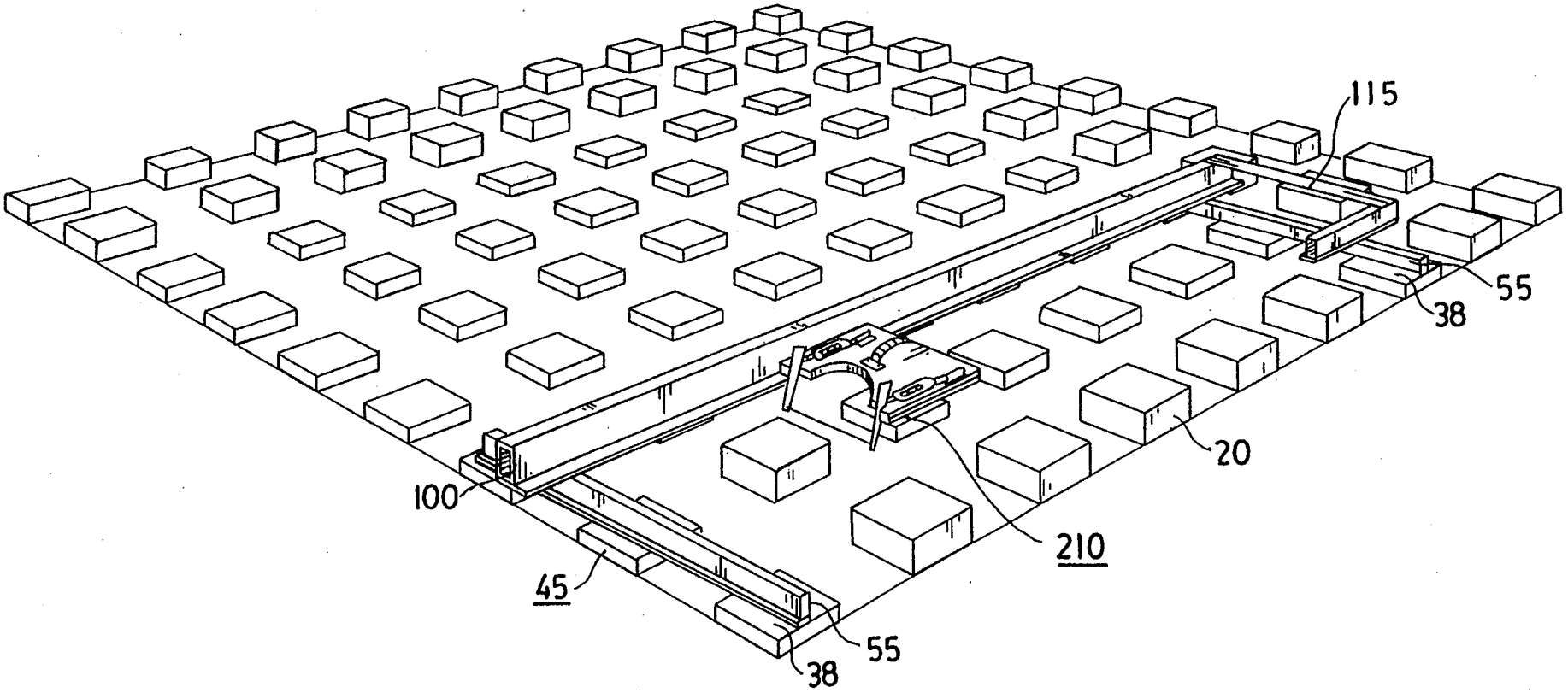
FIG. 4 is a perspective view showing the horizontal leveling of a single row of support pedestals based on the elevation of a previously leveled row, with one track of the levelling machine partially cut away.

Referring now to FIGS. 3 and 4, constructing the terrace floor of this invention using a levelling apparatus 200 can be seen to be a speedy and simple process. In these figures the process of bringing all the polystyrene support pedestals 20 to the same horizontal level is shown. The polystyrene pedestals 20 which have been glued to the substructure 11 using polystyrene adhesive or the like can be subjected to some weight by, for example, being stepped on, in order to ascertain that they are fully compacted. In FIG. 3 a "first row" 28 of seven polystyrene support pedestals 20 has already been horizontally leveled, and a "second row" 25 of seven polystyrene support pedestals 20 is in the process of being leveled. This is accomplished by placing the pair of tracks 100—100 of the levelling apparatus 200 on either side of the second row 25 of support pedestals to be leveled. The tracks 100—100 are connected at at least one end by an end connecting plate 115, and are supported by two support bars 110—110, one on each end. Each support bar 110 in turn rests upon two levelling legs 113—113, so that each end of the support bar 110 can be raised or lowered to varying levels by adjusting the corresponding levelling leg 113.

The proper level at which each levelling leg is to be set is established using a laser gun or other means known in the art. A cutting carriage 210, to be described in detail later, can be moved along the tracks, in order to heat shear a top section from the polystyrene support pedestals 20, creating a horizontally leveled top surface.

Once all the spaced apart rows (shown as every 7th row) have been horizontally leveled, the levelling apparatus 200 is turned 90° so that the tracks 100—100 now are on either side of a cross-row 45 of polystyrene support pedestals 20. Instead of resting on support bars, the leveling device 200 now rests across two parallel opposing wooden grade supports 55—55, which in turn rest across corresponding previously leveled polystyrene support pedestals 38—38. The wooden grade supports 55—55 are structured so that when they rest on previously leveled polystyrene support pedestals 38–38, the cutting carriage 210 is at the proper position for cutting the cross-row of polystyrene support pedestals 20. Thus the cutting carriage 210 is automatically positioned properly so as to level the cross-rows without further adjustments being needed (except for adjustments to the cutting wire as described below).

Figure 5:
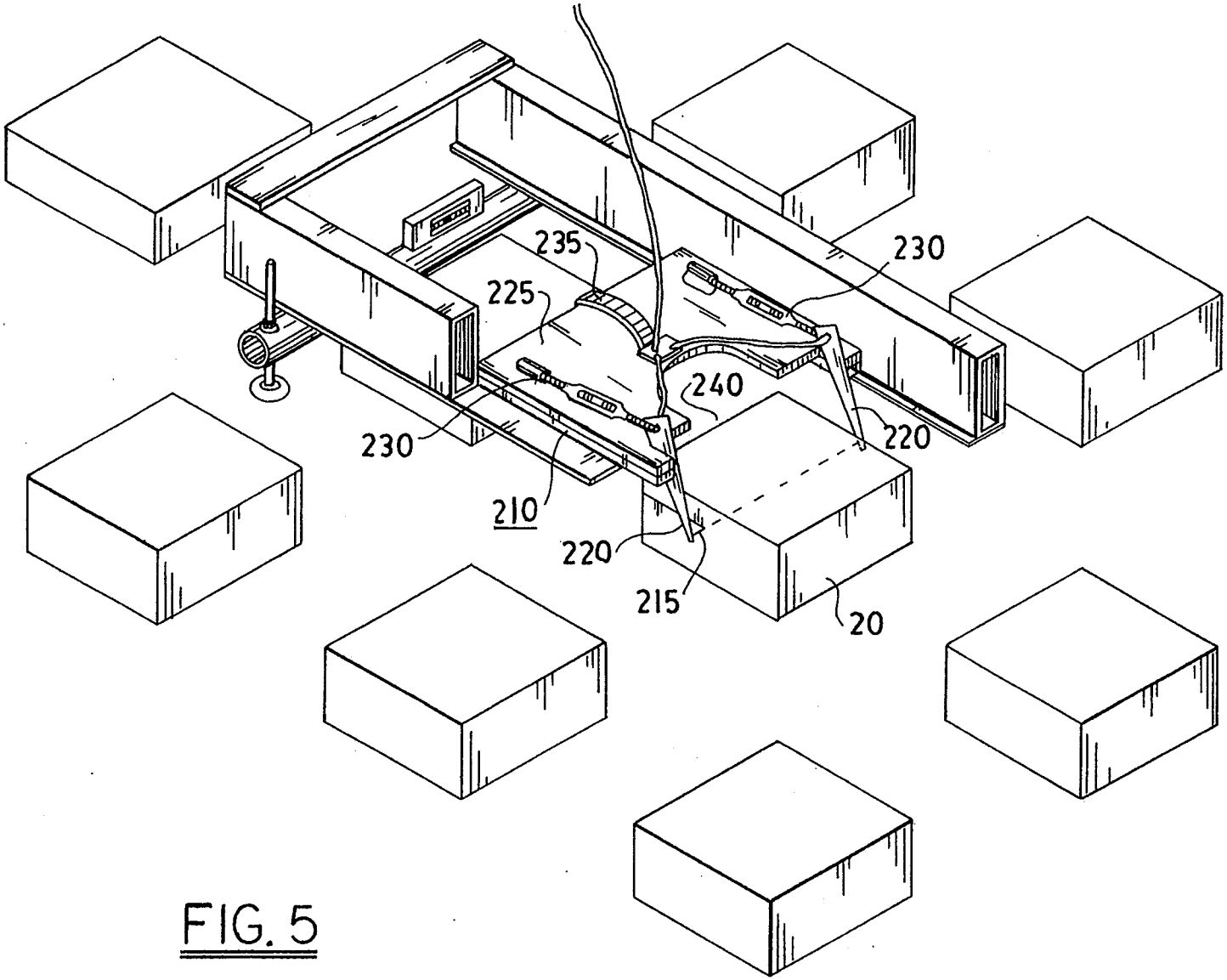
FIG. 5 is a perspective view of the leveling carriage in operation with both tracks of the levelling machine partially cut away, and showing the cutting wire in phantom.

FIG. 5 shows in greater detail the apparatus for shearing the tops off the polystyrene support pedestals 20. The cutting carriage 210 contains a heatable cutting wire 215 which is stretched very tightly to essentially a straight line, between two wire support arms 220—220 which, in turn, are suspended from the cutter base plate 225. It has been found that good results are obtainable using wire of diameters between 0.02 and 0.05 inches, with 0.035 inches being preferable. The wire of choice is 308 (ASTM specification) stainless MIG welding wire.

The two wire support arms 220—220 are formed of electrically conductive material. They are connected in turn to a source of electric power (not shown). The two wire support arms 220—220 are also each connected to a turn buckle 230. The turn buckles 230—230 can be used in conjunction with each other to adjust the grade of the cutting wire 215 so that, when electrically heated, it will shear the polystyrene support pedestals 20 so that their top surfaces 22 will be at a horizontal level with respect to one another. DC current of between 2 and 50 amp is applied to the wire. Wire temperatures of between 800° and 1600° F. may be used, with a temperature of 1200° F. being preferable.

A control handle 235 allows an operator to manually move the cutting carriage 210 down a row or cross-row of polystyrene support pedestals 20. A hand accessibility opening 240 is provided in the cutter base plate 225 so as to allow access underneath the cutting carriage 210 as may be needed, for example, to clear away debris.

Although not shown, the smaller polystyrene support posts 30 may be sheared as necessary to provide for drainhole clearance, as described above, by setting the levelling apparatus to an appropriate lower level. Alternatively, the support posts 30 may be cut to the correct size before being affixed to the substructure 11.

While this invention has been explained with reference to the structure disclosed herein, it is not confined to the details set forth and this application is intended to cover any modifications and changes as may come within the scope of the following claims:

What is claimed is:

1. A horizontally level terrace floor comprising:

a plurality of solid blocklike support elements, each element comprised of a single pedestal, said pedestals being fabricated of a heat shearable material, said pedestals being directly affixed in spaced apart relationship onto a non-horizontally level substructure, said pedestals being of non-uniform heights having been sheared to produce upper surfaces so that all said upper surfaces are horizontally level and parallel with respect one another and wherein said upper surfaces are non-parallel with respect to corresponding pedestal lower surfaces;

a plurality of joint dividers, set upon the upper surfaces of said pedestals; and a plurality of paving blocks laid directly on said pedestals, and abutting against said joint dividers.

2. The terrace floor of claim 1 comprising further a drain cover system comprised of a plurality of drain cover elements, wherein each drain cover element comprises:

a plurality of small support posts affixed in a spaced apart relationship to one another adjacent to a drainage hole in said substructure surface, and said small support posts being smaller in all dimensions than said pedestals;

spacer support means, supported on said small support posts, for providing a brace with an upper surface horizontally level with the upper surfaces of the support pedestals;

a joint divider, set upon an upper surface of said spacer support means, said spacer support means allowing support of a paving block directly above a drain hole while allowing liquid access to the drain hole.

3. The terrace floor of claim 2 wherein said spacer support means comprises:

a paving block; and a thin section of pedestal.

4. The terrace floor of claim 1 wherein said substructure comprises:

a bottom layer of concrete floor slab;

a layer of waterproofing membrane; and a layer of protective, insulating board.

5. The terrace floor of claim 1 wherein said substructure comprises:

a bottom layer of concrete floor slab;

a layer of waterproofing membrane;

a layer of protective board; and a layer of insulating material.

6. The terrace floor of claim 1 wherein said pedestals are comprised of polystyrene.

7. The terrace floor of claim 1 wherein said pedestals are affixed to said substructure by means of a polystyrene adhesive.

8. The terrace floor of claim 1 wherein said joint dividers are cruciform in shape.

9. The terrace floor of claim 1 wherein each pedestal has a single joint divider set in a central position on the upper surface of said support pedestal.

10. The terrace floor according to claim 9 wherein each said joint divider remains unaffixed to each said pedestal.

11. A horizontally level terrace floor comprising:

a plurality of solid blocklike support elements, each element comprised of a single pedestal, said pedestals composed of a heat shearable material, said pedestals being adapted to being directly affixed in spaced apart relationship onto a non-horizontally level substructure, said pedestals being of non-uniform heights, having been sheared to produce upper surfaces so that all said upper surfaces are horizontally level and parallel with respect one another, and wherein said upper surfaces are non-parallel with respect to corresponding pedestal lower surfaces;

a plurality of joint dividers, set upon the upper surfaces of said pedestals; and a plurality of paving blocks laid directly on said pedestals, and abutting against said joint dividers.

12. The terrace floor according to claim 11 further comprising a drain cover system comprised of a plurality of drain cover elements, wherein each drain cover element comprises:

a plurality of small support posts affixed in a spaced apart relationship to one another adjacent to a drainage hole in said substructure surface, and said small support posts being smaller in all dimensions than said pedestals;

spacer support means, supported on said small support posts, for providing a brace with an upper surface horizontally level with the upper surfaces of said pedestals;

a joint divider, set upon an upper surface of said spacer support means, said spacer support means allowing support of a paving block directly above a drain hole while allowing liquid access to the drain hole.

13. The terrace floor according to claim 11 wherein said spacer support means comprises:

a paving block; and a thin section of support pedestal.

14. The terrace floor according to claim 11 wherein said pedestals are comprised of polystyrene.

15. The terrace floor according claim 11 wherein said pedestals are affixed to the substructure by means of a polystyrene adhesive.

16. The terrace floor according to claim 11 wherein said joint dividers are cruciform in shape.

17. The terrace floor of according to claim 11 wherein each support pedestal has a single joint divider set in a central position on the upper surface of said support pedestal.

18. The terrace floor according to claim 17 wherein each said joint divider remains unaffixed to each said pedestal.

* * * * *